US005165876A

United States Patent [19]

Wang

[11] Patent Number: 5,165,876

[45] Date of Patent: Nov. 24, 1992

[54] TIRE PUMP

[76] Inventor: Ropin Wang, 5F No. 1 Lane 85 Kawang Fu North Rd., Taipei, Taiwan

[21] Appl. No.: 797,886

[22] Filed: Nov. 26, 1991

[51] Int. Cl.[5] ..... F04B 7/00; F04B 21/04

[52] U.S. Cl. ..... 417/511; 417/524; 417/527

[58] Field of Search ..... 417/511, 521, 523, 524, 417/527, 528

[56] References Cited

U.S. PATENT DOCUMENTS

| | | | |
|---|---|---|---|
| 2,255,305 | 8/1939 | Zehner | 417/528 |
| 3,904,325 | 9/1975 | Olofsson | 417/512 |
| 5,051,073 | 9/1991 | Newbold | 417/527 |

*Primary Examiner*—Leonard E. Smith
*Assistant Examiner*—Roland McAndrews
*Attorney, Agent, or Firm*—Browdy and Neimark

[57] ABSTRACT

A tire pump comprises a first cylindrical body, a second cylindrical body, a two-way air admission piston, a piston rod, a first one-way valve, a hand grip, a second one-way valve, a third one-way valve, a fourth one-way valve, and an air valve connection head. The second cylindrical body is fitted to one end of the first cylindrical body. The two-way air admission piston is disposed in the first cylindrical body in such a way that it divides the first cylindrical body into two air-receiving spaces. The piston rod is secured to one end of the two-way air admission piston. The first one-way valve is disposed at one end of the first cylindrical body, while the second one-way valve and the third one-way valve are disposed at other end of the first cylindrical body. The fourth one-way valve and the air valve connection head are arranged at one end of the second cylindrical body.

5 Claims, 4 Drawing Sheets 37
37a
37b
6
6
381
382
383
38
383
38
40
46
101
10
102
30
50
60
39
20
80
70
40
46
101
10
30
102
39
50
60
80
70

TIRE PUMP

BACKGROUND OF THE INVENTION

The present invention relates to a tire pump, and more particularly to a tire pump with two cylindrical bodies intended to improve its efficiency of inflating a tire with air.

The conventional tire pump of the prior art is limited in design in that only the forward movement of its piston can force the air into the tire. In other words, the efficiency of such prior art tire pump is greatly compromised in view of the fact that the backward movement of its piston does not force the air into the tire. There are improved tire pumps designed with means to permit the air to be pumped into the tire during both forward and backward movements of the piston; nevertheless such improved tire pumps are still defective in that they contain space which should be utilized to the fullest extent that their efficiency of air pumping is further improved.

SUMMARY OF THE INVENTION

It is therefore the primary objective of the present invention to provide a tire pump with means to make use of the space available in the pump so as to improve its work efficiency of inflating the tire.

In keeping with the principles of the present invention, the primary objective of the present invention is accomplished by a tire pump, which comprises mainly a first cylindrical body, a two-way air admission piston, a piston rod, a first one-way valve, a second one-way valve, an air valve connection head, and a connection head member. The two-way air admission piston is arranged in the hollow first cylindrical body in such a way that the first cylindrical body is divided into the first space and the second space. The piston rod is provided with an air duct passing therethrough axially and is fastened at one end thereof to the two-way air admission piston. The first one-way valve is disposed at one end of the first cylindrical body for permitting the air from the outside of the tire pump to enter the first space of the first cylindrical body, while the second one-way valve is disposed at other end of the first cylindrical body for permitting the air from the outside of the tire pump to enter the second space of the first cylindrical body. The air valve connection head is coupled with one end of the piston rod and is provided therein with an air passage in communication with the air duct of the piston rod. The connection head member is disposed on the air passage and is intended to make contact with the tire inflation valve. The tire pump of the present invention is characterized in that the body portion of its air valve connection head extends to include a round cylinder used as a hand grip, a second cylindrical body with one end thereof being fastened in the round cylinder of the air valve connection head and with other end thereof being fitted to the outside of the second one-way valve of the first cylindrical body, a third one-way valve disposed at the end of the second one-way valve facing the second cylindrical body for permitting the air outside the tire pump to enter the second cylindrical body, and a fourth one-way valve disposed at the place where the second cylindrical body and air valve connection head are joined together.

The foregoing features and functions of the present invention will be better understood by studing the following detailed description of the preferred embodiment in conjunction with the drawings provided herewith.

DETAILED DESCRIPTION OF THE PREFERRED EMBODIMENT

Figure 1:
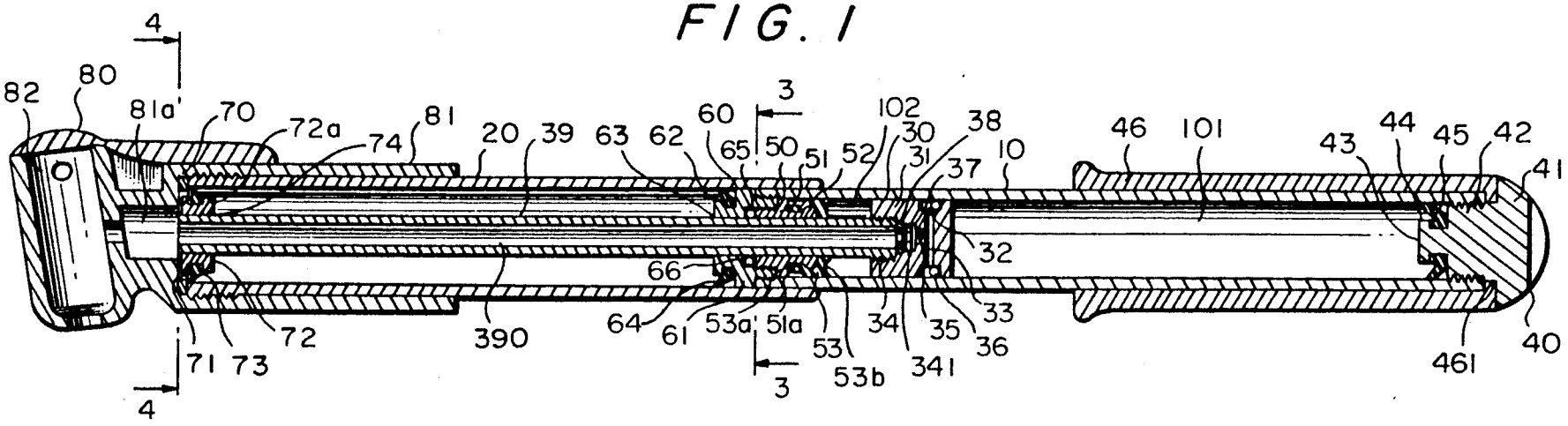
FIG. 1 shows a sectional view of the preferred embodiment of the present invention.
Figure 4:
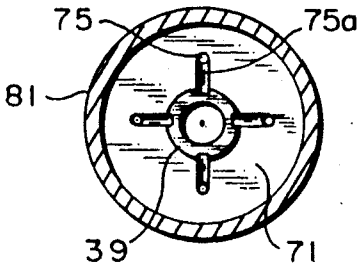
FIG. 4 shows a sectional view of the portion taken along the line 4—4 as shown in FIG. 1.

Referring to all drawings provided herein, the tire pump embodied in the present invention is shown comprising a first cylindrical body 10, a second cylindrical body 20, a two-way air admission piston 30, a piston rod 39, a first one-way valve 40, a hand grip 46, a second one-way valve 50, a third one-way valve 60, a fourth one-way valve 70, and an air valve connection head 80.

The first cylindrical body 10 and the second cylindrical body 20 are of hollow construction and are arranged in such a way that there is a clearance between the former and the latter for permitting the air outside the tire pump to flow therethrough.

Figures 5, 6, 7, 8, 9, 10:
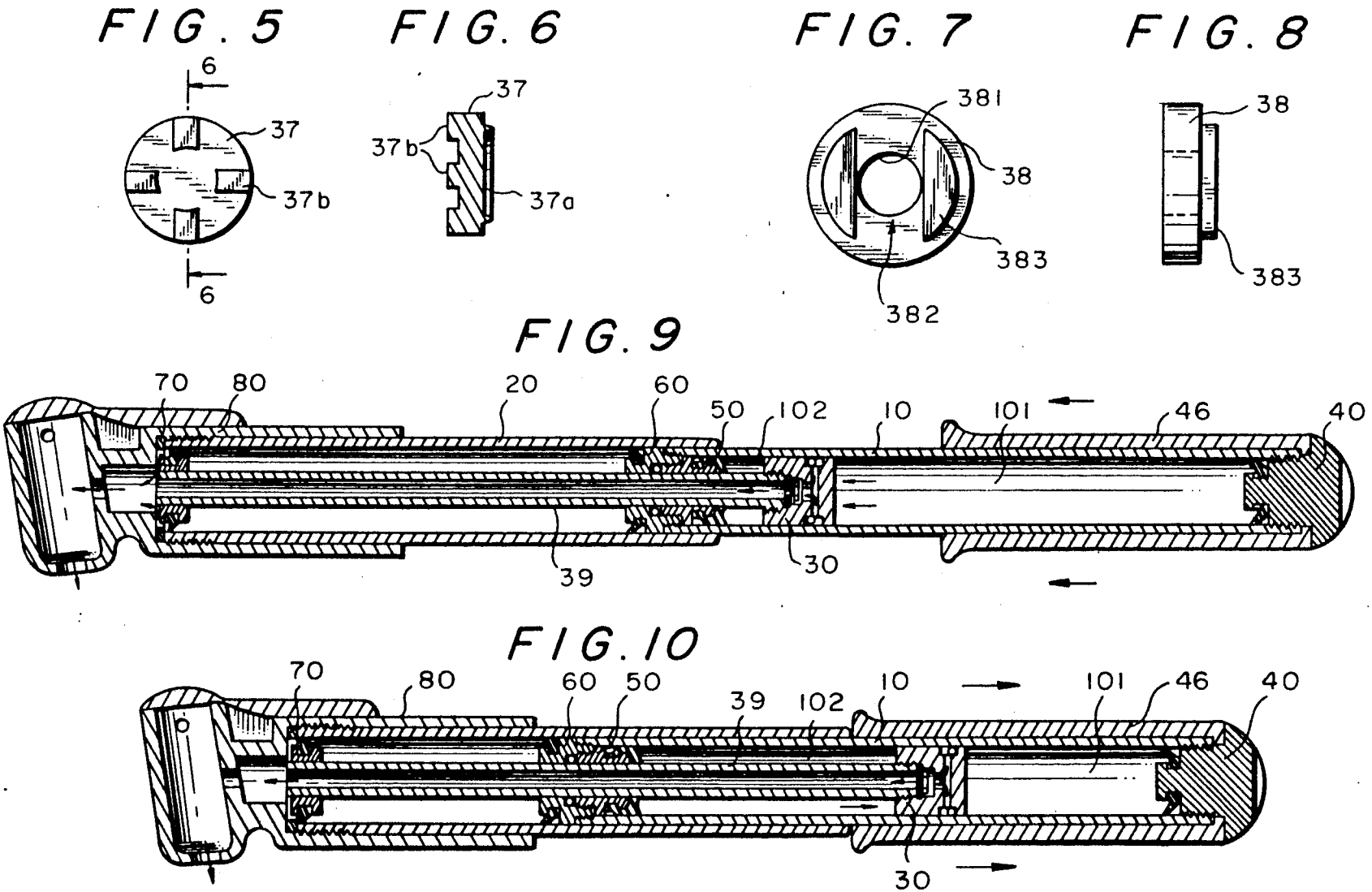
FIG. 5 shows a front view of the non-return valve as shown in FIG. 1.
FIG. 6 shows a sectional view of the portion taken along the line 6—6 as shown in FIG. 5.
FIG. 7 shows the front view of the non-return valve cap as shown in FIG. 1.
FIG. 8 shows the front view of the non-return valve cap as shown in FIG. 1.
FIG. 9 is a schematic view showing the preferred embodiment of the present invention at work.
FIG. 10 is another schematic view showing the preferred embodiment of the present invention at work.
Figure 11:
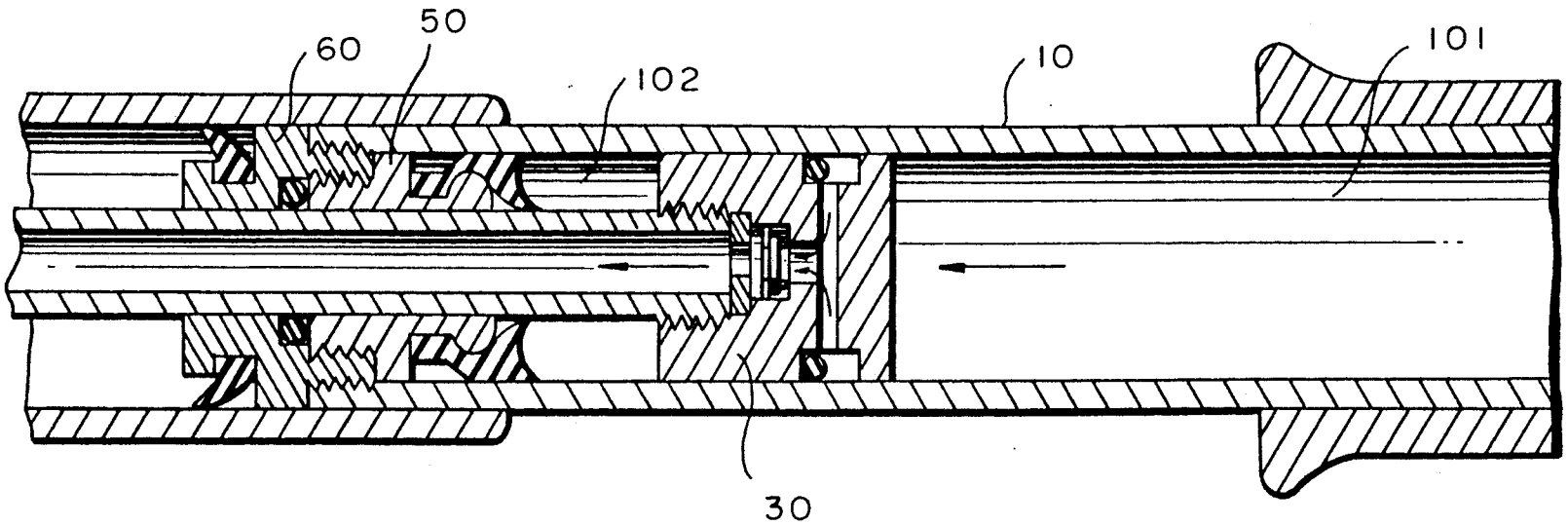
FIG. 11 is an enlarged section of FIG. 9.
Figure 12:
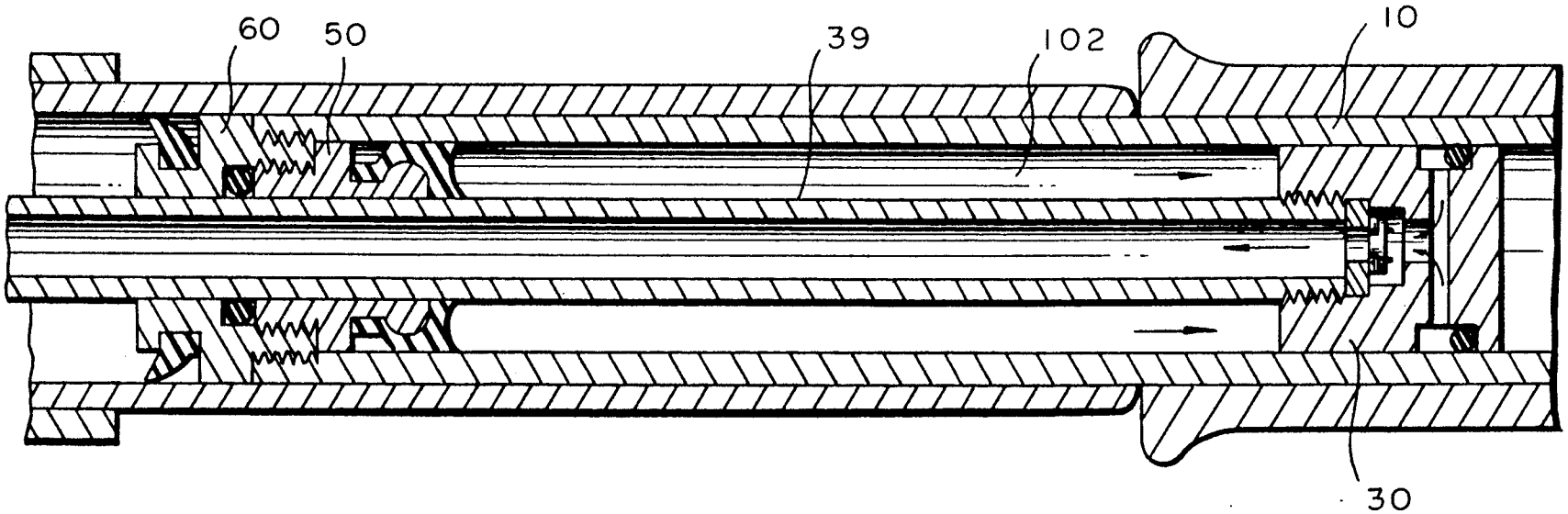
FIG. 12 is an enlarged section of FIG. 10.

The two-way air admission piston 30 is disposed in the first cylindrical body 10, which is in turn divided into the first space 101 and the second space 102. The two-way air admission piston 30 is composed of a piston body 31, an elastic washer 36, a non-return valve 37, and a non-return valve cap 38. The piston body 31 is of circular column and is composed of a circular receiving slot 32 intended to accommodate the elastic washer 36 and provided at the bottom wall thereof with an air admission hole 33 passing therethrough radially and at one end thereof with a round hole 34 disposed axially. The bottom wall of round hole 34 is composed of a receiving space 341 and a through hole 35 communicating with the air admission hole 33. The elastic washer 36 is disposed in the receiving slot 32 in such ways that it can slide axially and that it engages the inner wall of the first cylindrical body 10 in an airtight manner. The non-return valve 37 is of a disk shape and is disposed in the receiving space 341 in such a manner that it can move axially within a small range. The non-return valve 37 is provided with a flange **37*a* located on the side surface facing the bottom wall of the receiving space 341 and with a predetermined number of protrusions 37*b* located on the other side surface thereof. Situated between any two adjacent protrusions 37*b* is an air passage for air to flow through protrusions 37*b* when contacting valve cap 38. The non-return valve cap 38 arranged in the round hole 34 is confined by the piston rod 39 and is composed of a centrally-located axial hole 381 and an air duct 382 located radially on the surface thereof facing the end surface of the non-return valve 37. As shown in FIGS. 7 and 8, air duct 382 is created by the parallel walls of protrusions 383 formed on the face of valve cap 38**.

The piston rod 39 is fastened at one end thereof to the round hole 34 of the two-way air admission valve 30 and is provided axially with an air duct 390 communicating with the through hole 35 and thus serving as an exit for the high-pressure air to be released.

The first one-way valve 40 consists of a disk 41 having a threaded joint 42 of circular column extending therefrom. The threaded joint 42 is provided with two axially-oriented guide grooves 421, while the disk 41 is composed of two radially-oriented indentations 411 positioned correspondingly to the guide grooves 421 so as to form jointly an air admission passage of the first space 101. The threaded joint 42 is further provided with a flange 43, which forms a recess 44 in conjunction with the end surface of the threaded joint 42. A tapered washer 45 is disposed in the recess 44.

The hand grip 46 is fitted over one end of the first cylindrical body 10 and is composed of a radially-oriented projected ring 461 located at one end thereof for the purpose of fastening the first one-way valve 40 to one end of the first cylindrical body 10.

The second one-way valve 50 disposed in the inner end of the first cylindrical body 10 is composed of a main body 51, an axial hole 52, and a check ring 53. The main body 51 comprises a shoulder **51*a*, which forms with the inner wall surface of the first cylindrical body 10 a clearance intended to permit the air to enter the second space 102 of the first cylindrical body 10 from the outside of the tire pump. The main body 51 further comprises an axial hole 52 to accommodate the piston rod 39. The check ring 53 is composed of a body portion 53*a* extending outwardly and being of U-shaped construction in its cross section and of a valve flap 53*b* having outer edge engaging the inner wall surface of the first cylindrical body 10 in an airtight manner and having inner edge engaging the piston rod 39** in an airtight manner.

Figure 3:
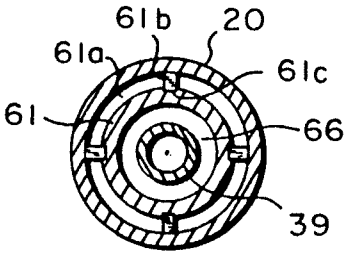
FIG. 3 shows a sectional view of the portion taken along the line 3—3 as shown in FIG. 1.
Figure 2:
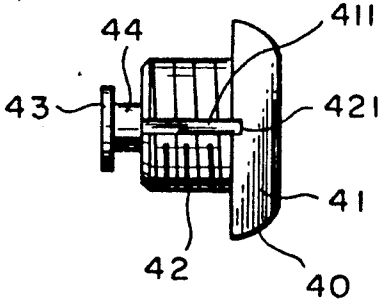
FIG. 2 shows a front view of the first one-way valve of the present invention.

The third one-way valve 60 is secured to one end of the first cylindrical body 10 after being fastened to the second one-way valve 50. As shown in FIG. 3, it comprises a main body 61 with a shoulder **61*a*. There is a clearance between the third one-way valve 60 and the second cylindrical body 20 so as to permit the air to flow into the second cylindrical body 20 from the outside of the tire pump. Located on one side of the shoulder 61*a* adjacent to the first cylindrical body 10 are four radially-oriented indentations 61*b*. The main body 61 further comprises on the side surface thereof the axially-oriented guide grooves 61*c* relative to the indentations 61*b*. Each of the indentations 61*b* is in communication with each of the guide grooves 61*c* so as to permit the air to enter the second space 102 of the first cylindrical body 10 from the outside of the tire pump. The shoulder 61*a* is further provided with a flange 62 disposed axially toward the interior of the second cylindrical body 20. The flange 62 forms a ring groove 62*a* along with the shoulder 61*a* and comprises centrally an axial hole 63 intended to accommodate the piston rod 39. A tapered washer 64 is disposed on the ring groove 62*a* in such a manner that its edge engages airtightly the inner wall surface of the second cylindrical body 20. The second one-way valve 50 and the third one-way valve 60 are coupled in such a way that their axial holes do not join together so that there is a recess 65 formed therebetween to accommodate therein a washer 66**.

The fourth one-way valve 70 is arranged at the other end of the cylindrical body 20 and is composed of a main body 71 and a flange 72 extending toward the interior of the second cylindrical body 20 to form a ring groove **72*a* in which a tapered washer 73 is disposed. The main body 71 consists of an axial hole 74 for use in coupling with the piston rod 39 and of four through holes 75 arranged circularly outside the edge of the axial hole 74. Each of the four through holes 75 is in communication with a guide groove 75*a*** disposed radially so as to form an exit duct for high-pressure air.

The air-valve connection head 80 comprises a cylindrical shell body 81 to which the second cylindrical body 20 is connected, with the fourth one-way valve 70 being sandwiched therebetween. The shell body 81 is provided with an air passage **81*a* communicating with the air duct 390 of the piston rod 39. Attached to the air passage 81*a* is a connection head member 82** intended to engage the tire inflation valve.

Now referring to FIG. 9, the air valve connection head 80 is shown engaging the tire inflation valve, with the hand grip 46 in the process of making a forward movement as indicated by arrows. The air present in the first space 101 of the first cylindrical body 10 is compressed by the two-way air admission piston 30 and the first one-way valve 40. In the meantime, the air in the second cylindrical body 20 is also under pressure by the third one-way valve 60. As high-pressure air in the first space 101 of the first cylindrical body 10 flows toward the gap located between the first cylindrical body 10 and the two-way air admission piston 30, the elastic washer 36 is forced to slide to the other side of the receiving slot 32 so as to permit the high-pressure air to flow through the air admission hole 33 and to prevent the high-pressure air from flowing into the second space 102. The pressure of air in the air admission hole 33 is greater than that of the air in the air duct 390 of the piston rod 39 (which is the same as air pressure in the tire.) As a result, the non-return valve 37 is pushed to allow the high-pressure air to enter the air duct 390 of the piston rod 39 and then into the tire intended to be inflated via the air passage formed by the gap among the non-return valve 37 and the receiving space 341 and the protrusion 376. When the air pressure in the second cylindrical body 20 is greater than that in the air passage of air valve connection head 80 (which is the same as air pressure in the tire,) the tapered washer 73 of the fourth one-way valve 70 is forced to bend so as to permit the high-pressure air to enter the air passage **81*a* of the air valve connection head 80 via through hole 75 and guide groove 75*a*. The air in the air passage 81*a* is then forced into the tire to be inflated. In the meantime, the air is permitted to enter the second space 102 from the outside of the pump via the gap between the first cylindrical body 10 and the second cylindrical body 20 and via the guide groove 61*c* of the third one-way valve 60, in view of an increase in the volume and a decrease in the air pressure inside the second space 102 of the first cylindrical body 10**.

Now referring to FIG. 10, the hand grip 46 is shown making a backward movement as indicated by arrows. The air in the second space 102 of the first cylindrical body 10 is restrained by the second one-way valve 50 and is compressed by the two-way air admission piston 30. As a result, the elastic washer 36 is forced to slide to other side of the receiving slot 32 so as to prevent the high-pressure air from entering the first space 101 and to allow the high-pressure air to flow through the air admission hole 33 and non-return valve 37 to enter the air duct 390 of the piston rod 39. The high-pressure air in the air duct 390 of the piston rod 39 can then enter the tire to be inflated via the air valve connection head 80. In the meantime, the air pressure in the first space 101 decreases so that the air outside the pump is permitted to enter the first space 101 via indentation 411 and guide groove 421 of the first one-way valve 40. As the air pressure in the second cylindrical body 20 decreases, the air outside the pump is premitted to enter the pump via the gap between the two cylindrical bodies 10 and 20 so that the tapered washer 64 of the third one-way valve 60 is bent to allow the air to flow therethrough to enter the second cylindrical body 20.

When the inflation of tire is completed or halted temporarily, the high-pressure air inside the inflated tire will not flow back into the tire pump, because of the facts that the high-pressure air in the inflated tire forces the non-return valve 37 to press tightly against the bottom wall of the receiving space 341, and that the flange 37*a* of the non-return valve 37 obstructs the through hole 35.

The advantages of the tire pump of the present invention can be summarized as follows:

(a) The air is being pumped into the tire not only at the time when the piston of the tire pump is making a forward movement but also at the time when the piston of the tire pump is making a backward movement.

(b) The air-pumping efficiency of the tire pump is greatly improved by means of two cylindrical bodies which make good use of the available spaces of the tire pump.

What I claim is:

1. A tire pump for inflating a tire having a tire inflation valve, said tire pump comprising:

(a) a first cylindrical body of hollow construction;

(b) a two-way air admission piston disposed in said first cylindrical body in such a way that it divides said first cylindrical body into the first space and the second space;

(c) a piston rod comprising axially an air duct and being secured at a first end thereof to one end of said two-way air admission piston;

(d) a first one-way valve disposed at a first end of said first cylindrical body;

(e) a second one-way valve disposed at a second end of said first cylindrical body opposing said first one-way valve provided with an axial hole;

(f) an air valve connection head arranged at a second end of said piston rod and provided with an air passage in communication with said air duct of said piston rod; and (g) a connection head member communicating with said air passage of said air valve connection head and engaging the tire inflation valve; and said air pump being characterized in that its air valve connection head has a body portion extending therefrom to form a cylindrical portion serving as a hand grip, said cylindrical portion comprising:

(a) a second cylindrical body containing a third space and disposed inside said cylindrical portion at one end thereof and outside said second one-way valve of said first cylindrical body at other end thereof;

(b) a third one-way valve provided with an axial hole and disposed at the side of said second one-way valve facing said second cylindrical body, with said axial hole of said third one-way valve and said axial hole of said second one-way valve forming a recess in which a washer is disposed; and (c) a fourth one-way valve provided with an axial hole and disposed at the joint between said second cylindrical body and said air valve connection head.

2. A tire pump according to claim 1, wherein said two-way air admission piston is of cylindrical construction and is provided at one end thereof with an axially oriented round hole and at a predetermined position thereof with a circular receiving slot having an air admission hole in communication with said round hole and having a sealing element disposed therein, said round hole being further provided at the bottom wall thereof with a receiving space in which a non-return valve and a non-return cap are disposed in such a way that said non-return valve is permitted to move axially within a small range.

3. A tire pump according to claim 2, wherein said non-return valve is a disk provided with a flange located on the side surface thereof facing the bottom wall of said receiving space of said round hole and with a predetermined number of protrusions located on the other side surface thereof.

4. A tire pump according to claim 2, wherein said non-return valve cap is composed of a centrally-located axial hole and an air duct disposed radially on the surface thereof.

5. A tire pump according to claim 1, wherein said second one-way valve comprises a check ring and a valve flap of U shape in its cross section.

* * * * *